United States Patent [19]

Longenecker

[11] 4,063,028

[45] Dec. 13, 1977

[54] SUSPENDED ROOF FOR ELECTRIC ARC FURNACE

[76] Inventor: Levi S. Longenecker, 61 Mayfair Drive, Pittsburgh, Pa. 15228

[21] Appl. No.: 695,365

[22] Filed: June 14, 1976

[51] Int. Cl.[2] ..... F27D 1/02

[52] U.S. Cl. ..... 13/35

[58] Field of Search ..... 13/9, 35; 110/99; 263/46; 432/62

[56] References Cited

U.S. PATENT DOCUMENTS

| | | | |
|---|---|---|---|
| 3,756,172 | 9/1973 | Brereton et al. | 13/35 X |
| 3,829,595 | 8/1974 | Nanjyo et al. | 13/35 |

*Primary Examiner*—R. N. Envall, Jr.
*Attorney, Agent, or Firm*—Parmelee, Miller, Welsh & Kratz

[57] ABSTRACT

A dual ring liftable and swingable roof for an electric furnace is provided with an outer, hanger-suspended, refractory tile, apron-defining roof portion between its outer fluid-cooled ring and its upwardly positioned inner ring. A central part of the roof is covered by refractory tile members that are hanger-suspended and that define spaced-apart, electrode-receiving and fume exhaust-discharging hole portions. An overhead metal frame structure has a pair of spaced-apart, water-jacketed, primary side beams that extend across the roof to support a centrally disposed air supply ductwork that extends about the hole portions, and that supplies cooling air to adjacent hanger and tile member. A quadrant arrangement of secondary beams is utilized, to connect the inner and outer ring members; one part of the secondary beams is also water-jacketed to connect opposite ends of the pair of primary beam members and provide a continuous flow of cooling fluid.

28 Claims, 28 Drawing Figures

SUSPENDED ROOF FOR ELECTRIC ARC FURNACE

BACKGROUND OF THE INVENTION

1. Field of the Invention

This invention relates to an improved liftable furnace roof for an electric arc furnace in which its refractory tile members are mounted in a suspended relation from its metal structure and particularly, to a dual ring structure that enables an improved application of cooling fluid to higher temperature portions of the roof. A phase of the invention deals with a roof which carries its own exhaust hood and enables the introduction of ambient air into the hood out-flow chamber.

2. Description of the Prior Art

As pointed out in my co-pending application Ser. No. 584,631 of June 6, 1975, now U.S. Pat. No. 3,967,048 difficulties have heretofore been encountered in providing and maintaining roof constructions for electric arc furnaces. This is particularly true in view of the fact that the roof has to be tilted about 45° for the furnace tapping operation and is to be lifted and swung, and utilized with electrodes during the operation of the furnace. In my co-pending application I have disclosed a roof construction which makes an effective and practicable utilization of refractory tile or block members in a so-called sprung type of roof relationship by minimizing compression thrust loading. To meet the demand for even longer roof life from the standpoint of its tile members, particularly for larger diameter roofs, e.g., twenty-two or more feet in diameter, there is a need for a so-called suspended type of roof of minimum weight which may fully utilize basic brick that normally do not have the strength for utilization in a sprung roof construction, and which will enable the use and efficient cooling of hanger castings and other supporting metal work.

SUMMARY OF THE INVENTION

It has thus been an object of the present invention to devise a new and improved liftable roof construction for an electric furnace and the like which will have a greatly increased operating life and will enable the full suspension mounting of refractory tile or block members.

Another object of the invention has been to provide a dual, concentric ring type of furnace roof in which refractory tile members are hanger-suspended in two groups, with the first group providing an outer apron portion and the second group providing a major area central portion, and in which an exhaust hood is carried by structure of its central area.

A further object of the invention has been to provide a liftable electric furnace roof that has improved strength with a minimization of weight and which is fluid-cooled at strategic areas to lengthen the life of the metal as well as the refractory members of which it is constructed.

A still further object of the invention has been to provide a liftable roof for an electric furnace that utilizes a fluid dispensing and dispersing ductwork in an encircling relation about electrode and fume hole portions of its central area.

These and other objects of the invention will appear to those skilled in the art from the illustrated embodiment and the claims.

DESCRIPTION OF PREFERRED EMBODIMENTS

Figure 1:
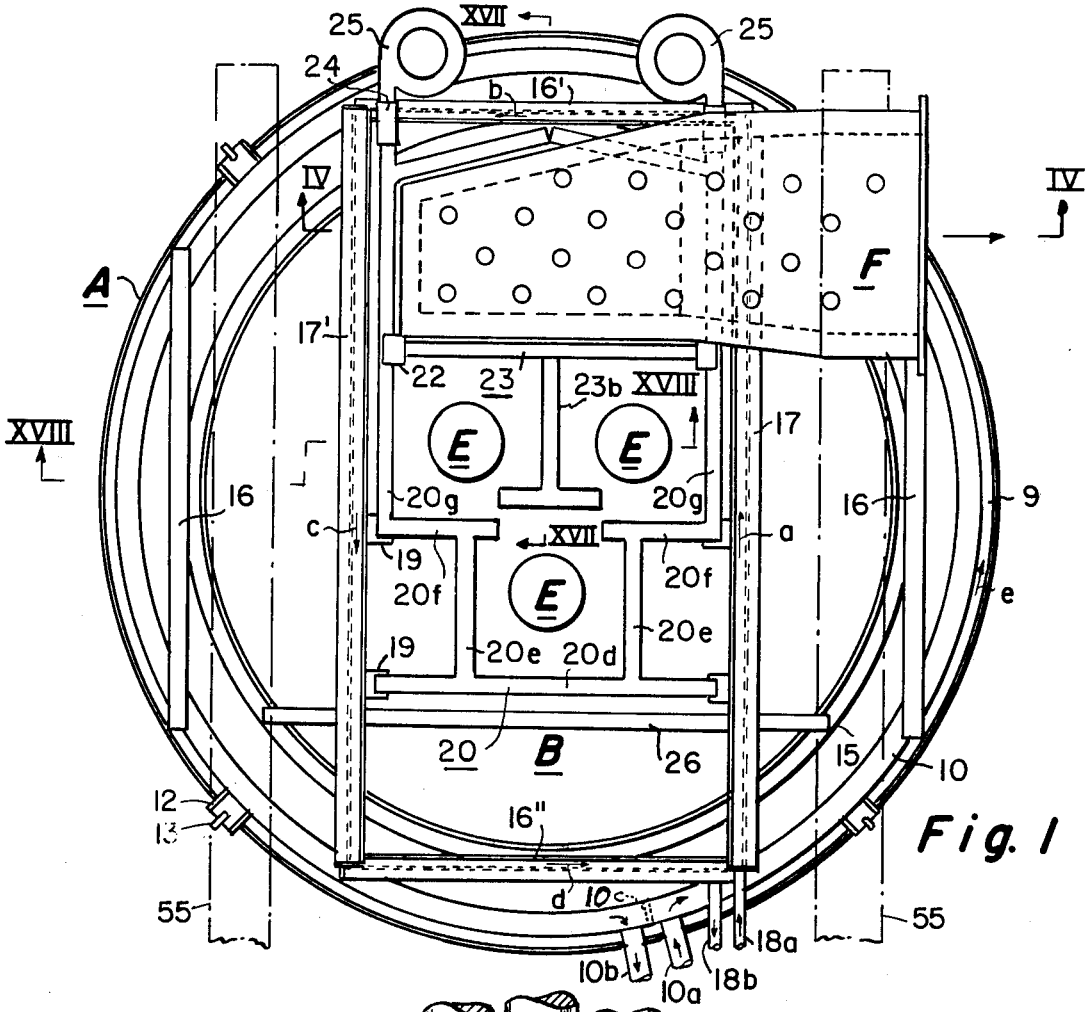
FIG. 1 is a top plan view of a furnace roof constructed in accordance with the invention.
Figure 6:
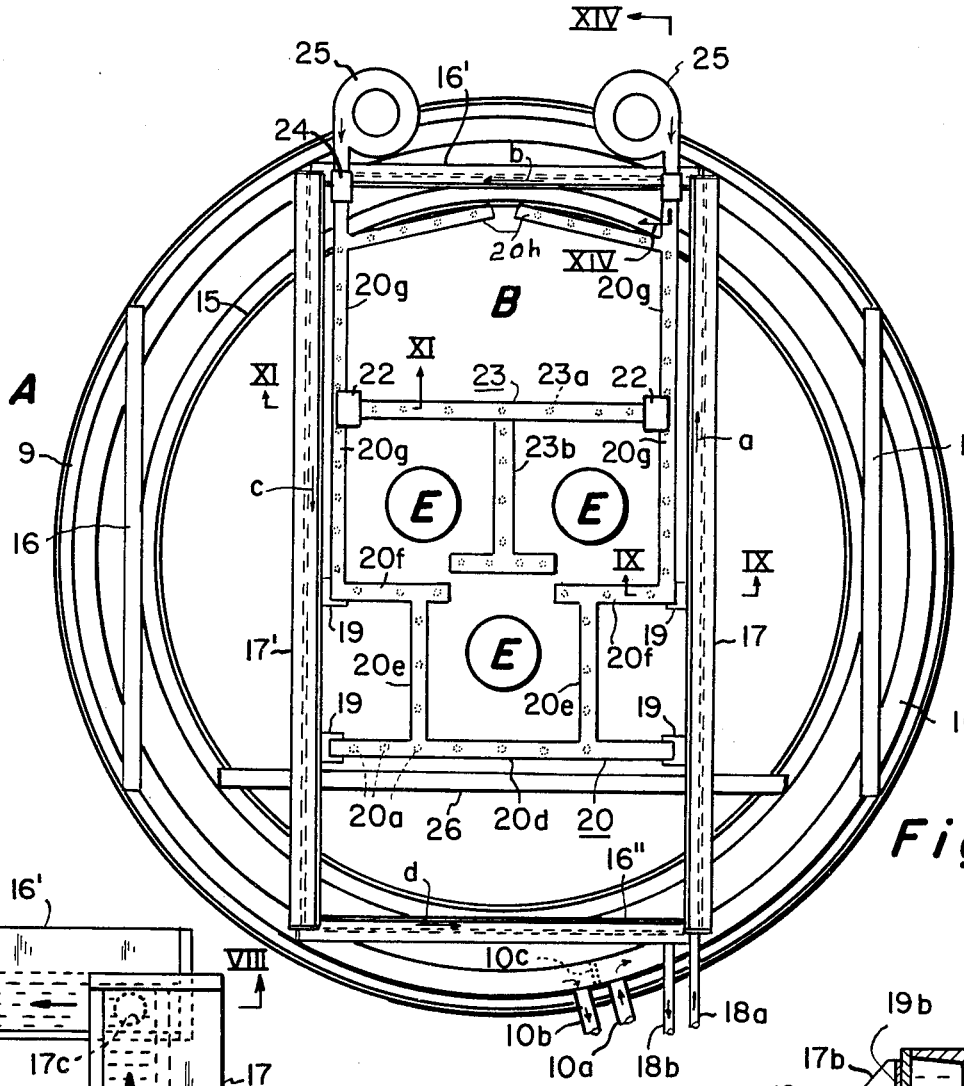
FIG. 6 is a plan view of the scale of FIG. 1 with the exhaust fume omitted to show details of the layout of a ductwork structure employed for supplying cooling air to a central area of the roof.
Figure 7:
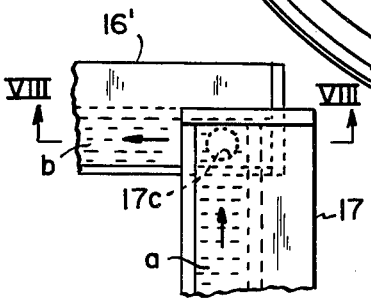
FIG. 7 is an enlarged fragmental plan view showing details of the construction of a typical connecting joint, taken from a back, right hand corner of a fluid-jacketed frame shown in FIG. 6.

In carrying out the invention, a circular roof B of minimized weight has been devised for conventional swingable and liftable positioning with respect to an upper rim flange 9 of the mouth portion of an electric arc melting furnace A. An overhead metal frame structure carries the roof B and includes a pair of substantially centrally disposed main or primary beam members 17 and 17' (see FIGS. 1, 2, 6 and 13) that extend adjacent to and in an opposed relation along opposite side areas thereof and, at their ends, connect outer and inner, circular, compartmentalizing metal ring members 10 and 15. Both the primary beam members 17 and 17' and the outer ring member 10 are provided with cooling fluid or waterjacketing along their respective length extents. As shown in FIGS. 1 and 6, cooling fluid is supplied to the jacketing of outer ring 10 at the tower-supported or turret end of the roof B, by an inlet represented by flexible inlet hose or conduit 10*a* and, after circulating along its closed-off chamber is exhausted, as warmed, through an outlet represented by flexible hose or conduit 10*b*. A baffle 10*c* isolates the inlet and outlet portions of the ring jacketing. Flow chamber *e* of the jacketing of the outer ring member 10 is shown in FIGS. 14, 17, 18 and 19.

Figure 18:
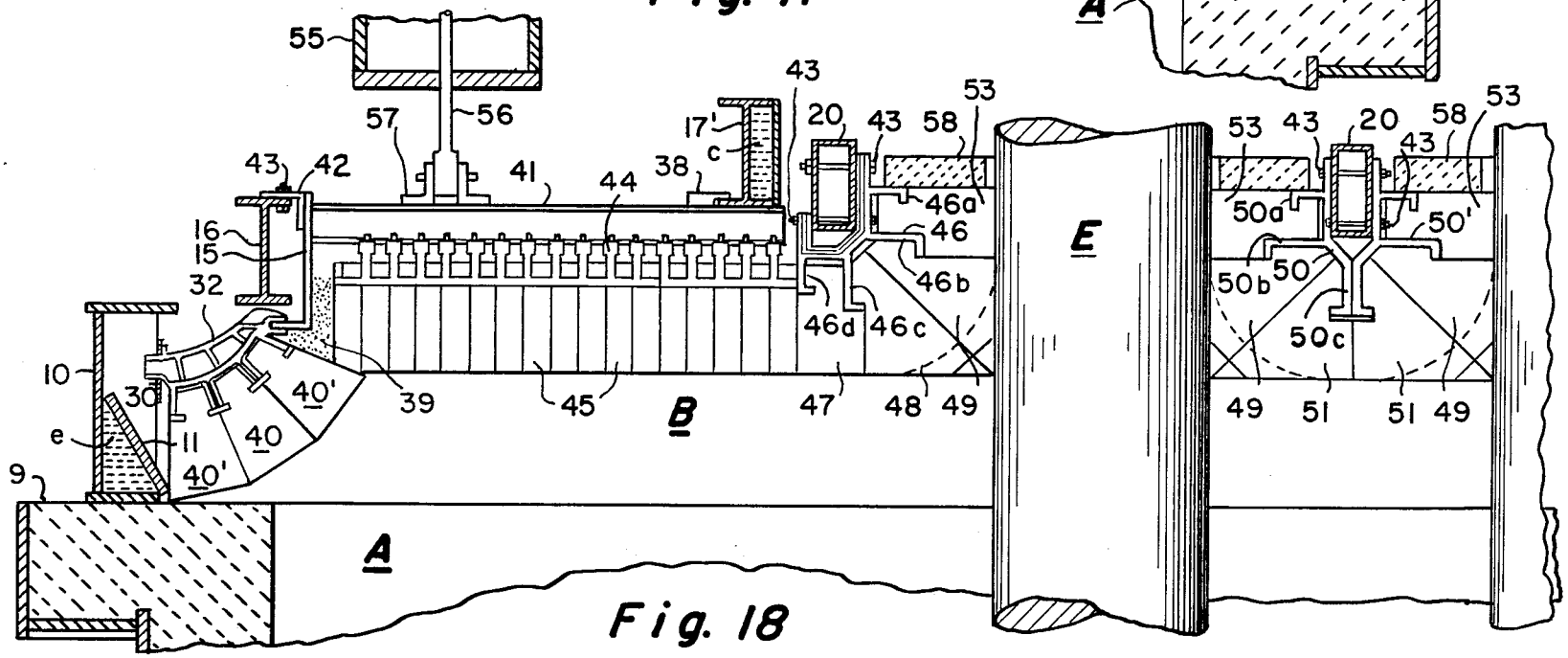
FIG. 18 is a fragmental end section in elevation through the furnace roof of and taken along line XVIII—XVIII of FIG. 1 and in a right angular relation with respect to FIG. 17.

The supporting metal frame of the roof B, as shown in FIGS. 1 and 6, has an outermost set or group of quadrantpositioned, secondary, lower level I-beams 16, 16' and 16'' that are substantially equally spaced as opposed side and end portions along the two-part ring assembly of the roof, and that serve as supporting connecting members between the outer and inner ring membes 10 and 15 thereof. As shown in FIG. 18, the inner ring 15 is carried in a radially inward and upwardly positioned relation with respect to the outer, fluid-jacketing ring 10. End-positioned, cross-extending secondary beams 16' and 16'' serve as connecting members for opposite ends of the primary beams 17 and 17', and define a rectangular support frame structure therewith. To enable a continuous flow of cooling fluid, such as water, the secondary beams 16' and 16'' are also water-jacketed, see FIGS. 1, 6, 7 and 8, and are connected at their respective ends by passages 17*c* to define a continuous flow channel from one end of the primary beam member 17 therealong, across the secondary beam 16', along the primary beam 17', and then across the secondary beam 16'.

As shown particularly in FIGS. 1 and 6, cooling fluid may be introduced at the turret end of the roof B into primary beam 17' through an inlet represented by flexible hose or conduit 18*a* and, after circulating, warmed fluid may be discharged or exhausted through an outlet represented by flexible hose or conduit 18*b* at one end of the secondary beam 16', adjacent the conduits 10*a* and 10*b* that provide cooling fluid flow along the jacket of outer ring member 10. In the FIGS., *a, b, c,* and *d,* respectively, represent waterjacketed chambers that are provided along inner peripheral portions of the base members 17, 16', 17' and 16'', and along which the cooling fluid flows continuously from inlet 18*a* out of outlet 18*b*.

In addition to the primary and secondary supporting beams, cooling fluid or air dispensing, dispersing ductwork 20, 23 has been provided and defines separation lines or areas about and substantially enclosing open portions in the roof representing hole portions for electrodes E and for fume exhaust to a hood F. The ductwork 20, 23 has spaced-apart fluid spray, open portions or orifices 20*a* and 23*a* (see FIGS. 6, 9, 10 and 11) along a bottom wall thereof to direct cooling air downwardly in the form of zoning or isolating curtain walls or lines between and about the fume exhaust and electrode hole portions of the roof. As shown particularly in FIGS. 1 and 6, the main portion of the ductwork represented by 20 has a pair of side legs 20*g* extending along the inner sides of the primary beams 17 and 17', with a pair of foot branches 20*h* extending along the inner ring 15 of the fume exhaust opening. Fully cross-extending foot branch 20*d* is connected by secondary leg branches 20*e* to short-length foot branches 20*f*, and at its opposite ends, is connected to the side legs 20*g* by Z-shaped insulative support brackets 17 (see also FIGS. 9 and 10).

Figure 11:
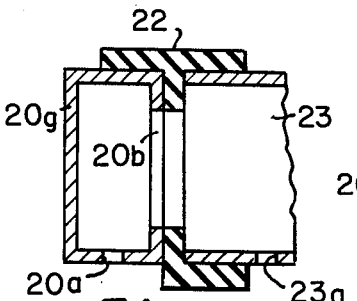
FIG. 11 is a fragmental section in elevation on the scale of FIG. 10 and taken along the line XI—XI of FIG. 6.
Figure 26:
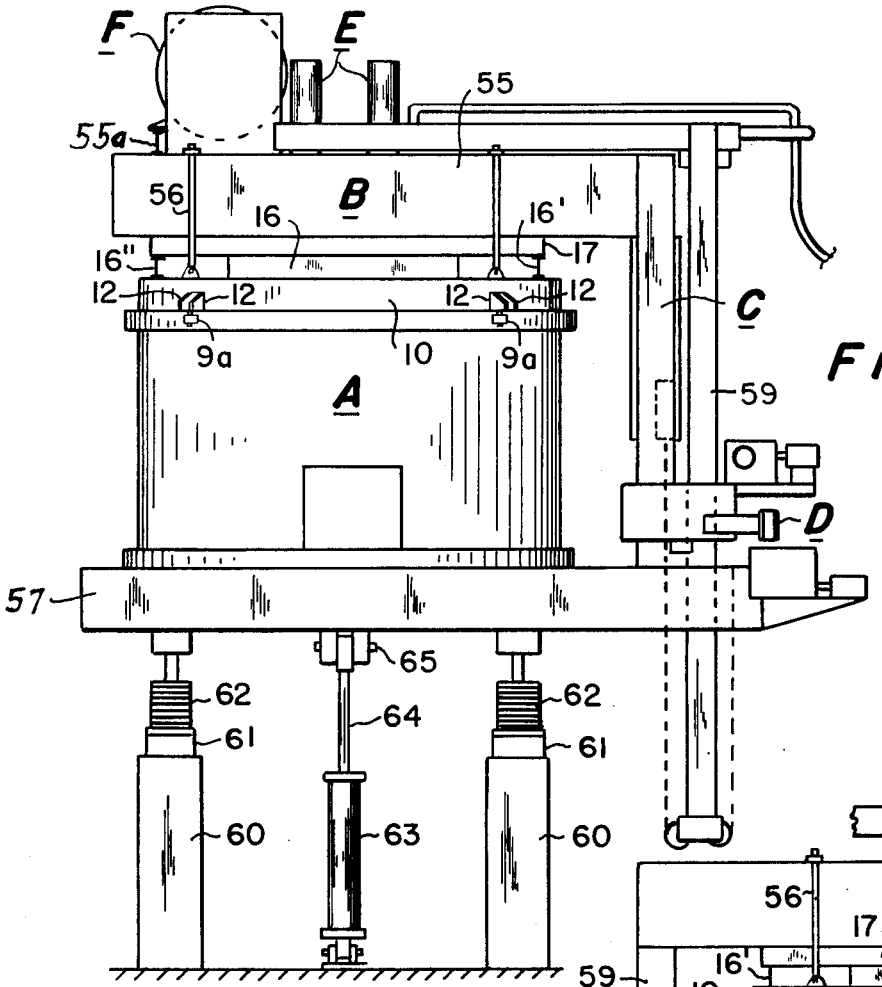
FIG. 26 is a side elevation on a reduced scale showing a furnace roof of the invention in a typical employment with a tiltable electric arc furnace that has means for raising, lowering and swinging the roof in a suspended relation.
Figure 27:
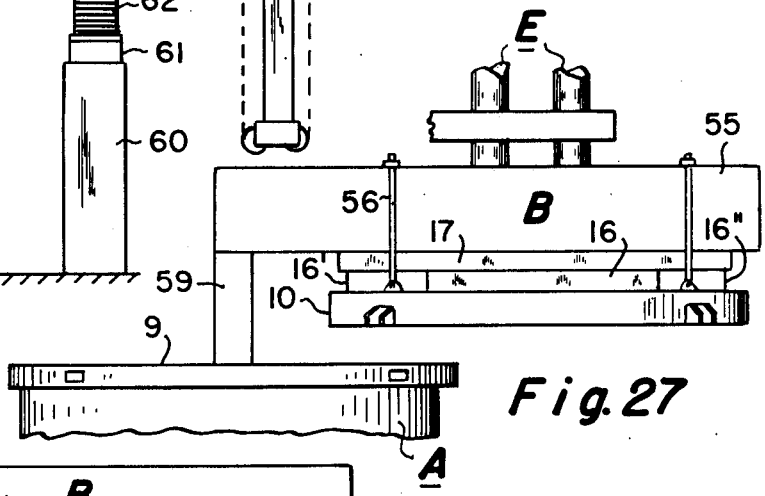
FIG. 27 is a fragmental side view in elevation on the scale of FIG. 26, and showing the roof in a raised and outward swung position with respect to a mouth ledge of the furnace.
Figure 28:
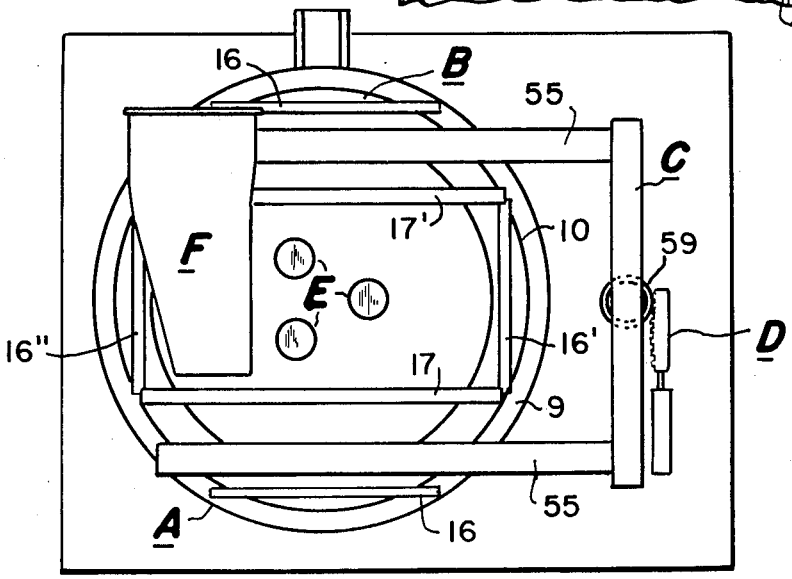
FIG. 28 is a top plan view on the same scale as and of the furnace assembly of FIG. 26.

A fully cross-extending, opposite foot branch 23 has a T-shaped central portion 23*b* and, at its opposite ends, is connected to receive cooling fluid or air from the side legs 20*g* by insulative sleeves 22 (see also FIG. 11). As shown, the ductwork 20, 23 serves to substantially enclose and isolate roof areas about the openings for the electrodes E and the fume-receiving hood F (see FIG. 1). The ductwork may be supplied with cooling fluid or air by electric motordriven blowers 25 that are shown mounted on the frame structure at an end thereof that is opposite to a lifting turret C, such as shown in FIGS. 26, 27 and 28. An insulative conduit sleeve 24 (see also FIG. 14) is employed to connect each of the blowers 25 to an end of an associated leg 20*g*.

Figure 9:
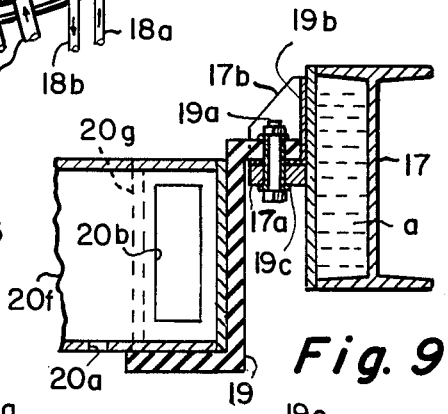
FIG. 9 is a fragmental section in elvation on the scale of FIG. 8 and taken along line IX—IX of FIG. 6.
Figure 8:
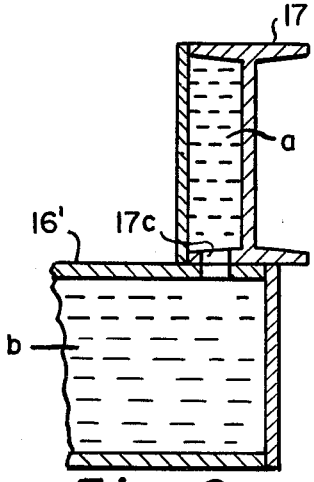
FIG. 8 is a fragmental section in elevation on the scale of FIG. 7, taken along the line VIII—VIII of FIG. 7.
Figure 12:
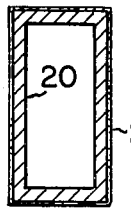
FIG. 12 is a section in elevation on the scale of FIG. 11, showing a typical section through ductwork of FIG. 6.
Figure 10:
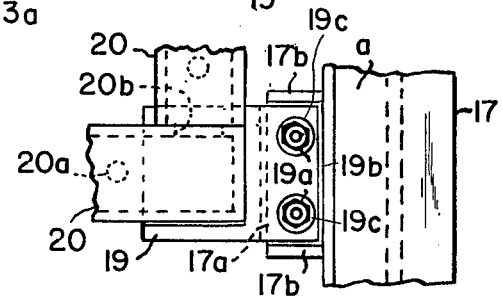
FIG. 10 is a fragmental plan view on the scale of and showing insulated joint structure of FIG. 9.

The purpose of electrically insulative parts, such as 19, 19*b*, 19*c* and 22 and 24, is to electrically isolate the three electrode areas as much as possible for minimizing corona leakage and other adverse electrical effects. FIGS. 6, 9 and 10 show how the ductwork 20, 23 may be securely mounted on the frame members 17 and 17'. With reference to FIGS. 9 and 10, a pair of shelves 17*a* extend from the waterjacketed side plate of the beams 17, 17' and each shelf has a pair of gussets or ears 17*b* that serve to center and mount an upper end of an associated Z-shaped bracket 19 thereon. The bracket 19 may be of any suitable insulative type of material, such as of reinforced asbestos or fiberglass; if it is of metal construction, then an insulative angle-shaped pad 19*b* and tubular sleeve 19*c* may be used (see FIG. 9) to electrically isolate the duct 20 from the beams 17, 17' and from a connecting mounting bolt and nut assembly 19*a*.

As shown particularly in FIG. 6 of the drawings, the ductwork 20 and 23 is fully positioned within the spacing defined between the pair of primary beam membes 17 and 17' and secondary beam members 16' and 16''; its side legs 24*g* extend longitudinally along and adjacent to the beam members 17 and 17'. The ductwork, as shown, defines an enclosing area about each open portion in the central furnace roof and as represented by the electrode holes and the fume exhaust hole. In this connection, duct work 20, 23 and branches 20*d*, 20*e*, 20*f*, 20*g* and 23*b*, separate the electrode hole portions in such a manner that they are encircled and isolated with respect to each other and that the heat from one is confined within its own central area. Further as shown, the fume opening in the furnace roof is substantially enclosed by ductwork 23 and branches 20*g* and 20*h*. In this manner, a cooling fluid or air curtain may be maintained between and substantially about the electrode and fume portions through the agency of the ductwork and the down-directed orifices 20*a* and 23*a*.

Figure 17:
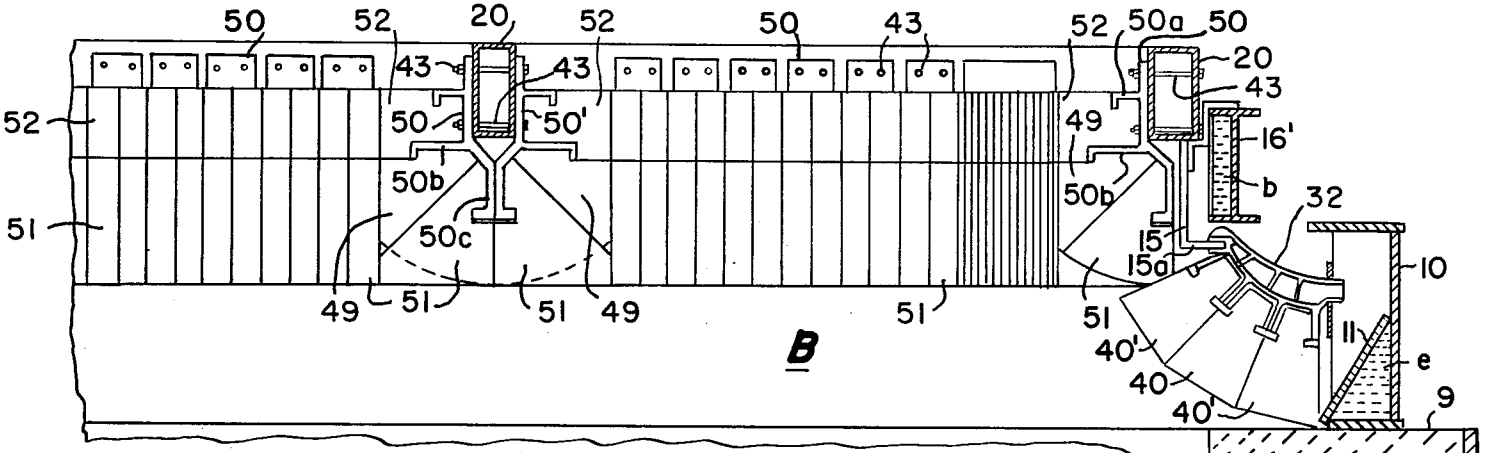
FIG. 17 is a fragmental enlarged side section in elevation taken along the line XVII—XVII of FIG. 1 and illustrating hanger mounting of tile members.
Figure 19:
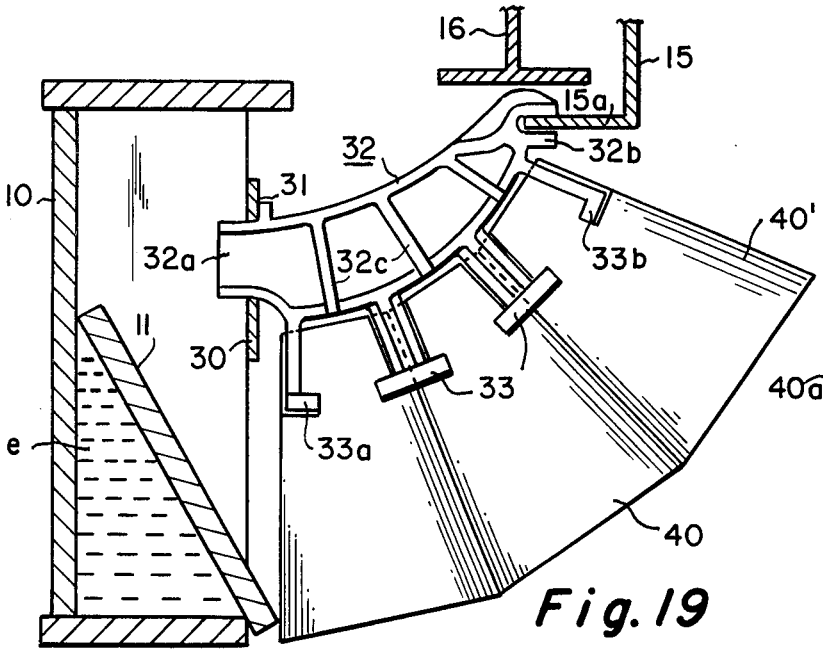
FIG. 19 is an enlarged fragmental detail in elevation in partial section showing the use of tapered tile members for closing-off the roof between its outer and inner ring members; the same arrangement is illustrated in FIG. 18.
Figure 21:
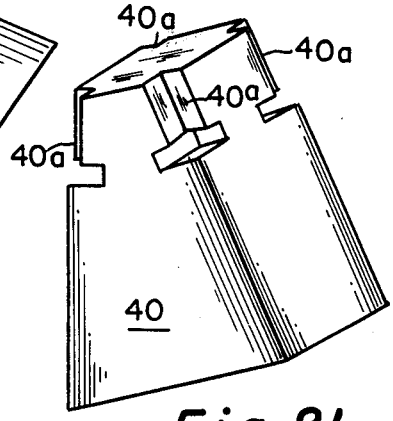
FIG. 21 is an isometric view in elevation illustrating the construction of tapered refractory apron tile members shown used in the closing-off assembly of FIGS. 19 and 20.
Figure 20:
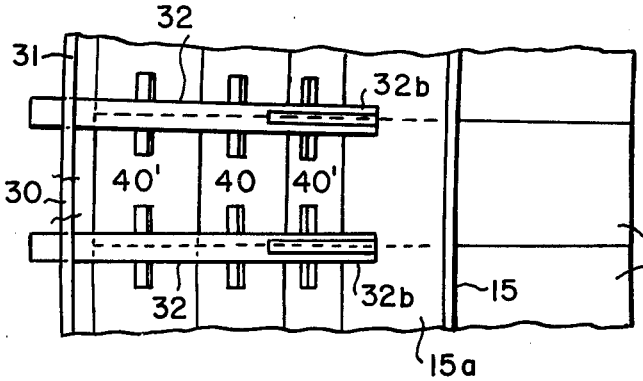
FIG. 20 is a fragmental top plan view on the scale of FIG. 19 and showing aplan view of the tile assembly of such figure.
Figure 22:
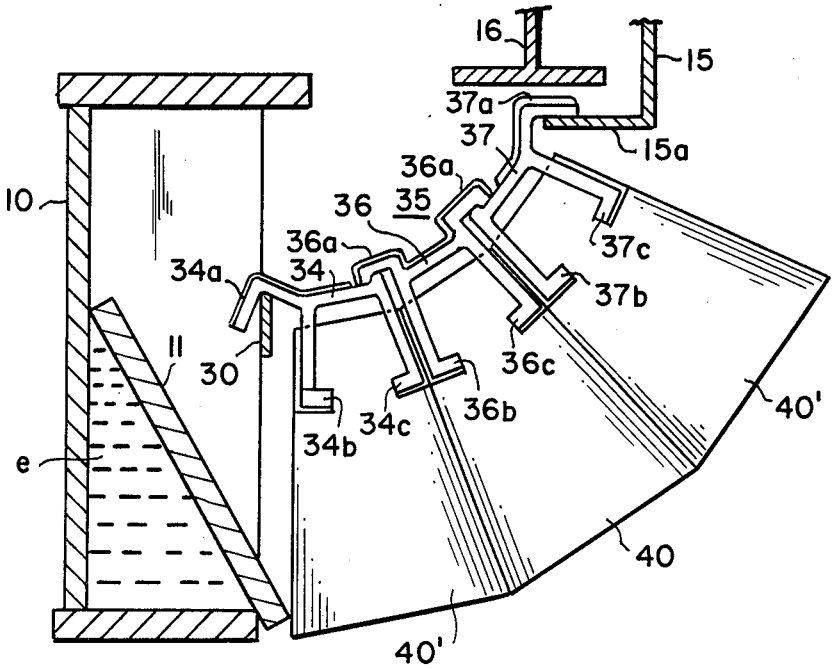
FIG. 22 is a view on the scale of and similar to 19, showing a modified form of apron hanger construction which employs a group of interfitting hanger castings in place of an integral hanger casting shown in FIG. 19, and is particularly suitable for repair or maintenance useage.

Referring particularly to FIGS. 17 and 18, the inner ring member 15 has a radially-inwardly and upwardly spaced relation with respect to the outer, fluid-jacketed, furnace mouth-closing ring 10 to define an outer roof area that is closed-off by tapered apron block or tile members 40, 40' which are retained in a suspended relation by unitary hanger castings such as 32 shown in FIG. 19 or assemblies such as shown in FIG. 22. Full leg and foot portions 33 of the casting 32 and half portions 33*a* and 33*b* are adapted to fit within latching portions 40*a* formed along upper edges of apron tile member 40, see FIGS. 19, 20 and 21. The hanger 32 is shown of unitary construction and as having an outer end portion 32*a* that is adapted to seat between a pair of metal banding strips 30 and 31 that are secured, as by weld metal, to extend along the inner side of the ring 10. The opposite end of the hanger 32 has a bifurcated latching portion 32*b* adapted to fit on a bottom flange 15*a* of the ring 15.

To facilitate repair work and to replace a hanger after repair has been accomplished, hanger assembly 35 (shown in FIG. 22) may be used in place of the unitary hanger 32. End castings 34 and 37 cooperate with an intermediate or central casting 36 and in an interlatching manner, as illustrated. The foremost end portion of the hanger 34 has a downwardly turned latching finger 34 that is adapted to fit on banding strip 30, while the opposite or inner, end-positioned hanger 37 has a turned-over or angle-shaped latching finger 37*a* to rest on the bottom flange 15*a* of the inner ring 15. The hanger casting 34 has, as shown, a pair of half latching leg and foot portions 34*b* and 34*c* for carrying a tile member 40'. The intermediate casting 36 has a pair of shoulder fingers 36*a* to latch on the shoulders of hangers 34 and 37, and a pair of half foot and leg portions 36*b* and 36*c* for carrying an intermediate tile member 40. Finally, the innermost and uppermost casting 37 has a pair of opposed outer and inner, leg and foot half portions 37*b* and 37*c* to carry an innermost tile member 40' of the assembly shown in FIG. 22.

Figure 13:
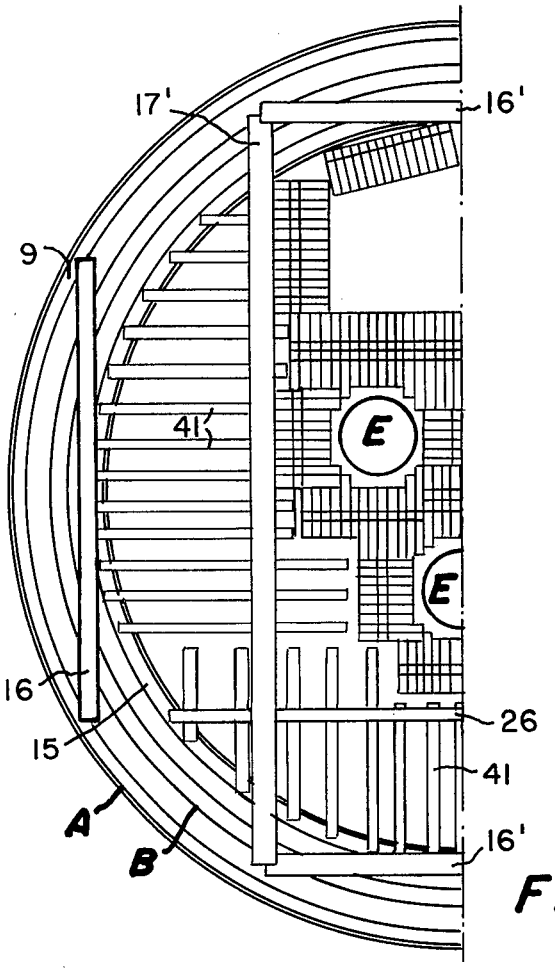
FIG. 13 is a half plan view on the scale of and of the roof of FIGS. 1 and 6; it particularly illustrates the arrangement of metal beam and frame structure, as well as the positioning of refractory tile around electrode and fume holes or openings in the roof.
Figure 14:
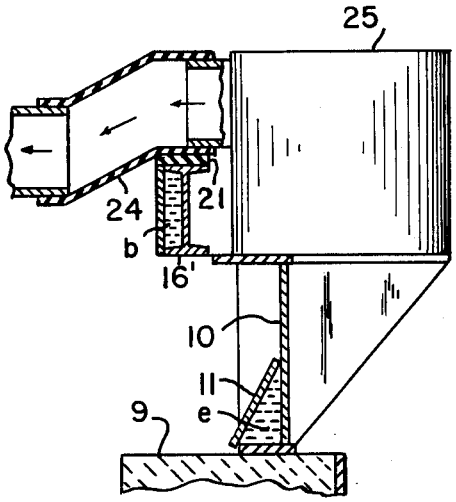
FIG. 14 is an enlarged fragmental section in elevation taken along the line IV—IV of FIG. 6 and illustrating the mounting of an air blower.
Figure 15:
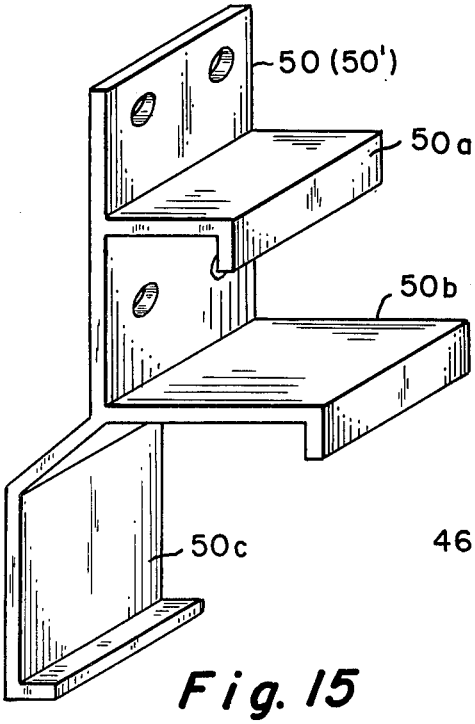
FIGS. 15 and 16 are enlarged isometric views in elevation illustrating nose hanger castings employed in the roof that are shown in a mounted, tile suspending relation in FIG. 18.
Figure 16:
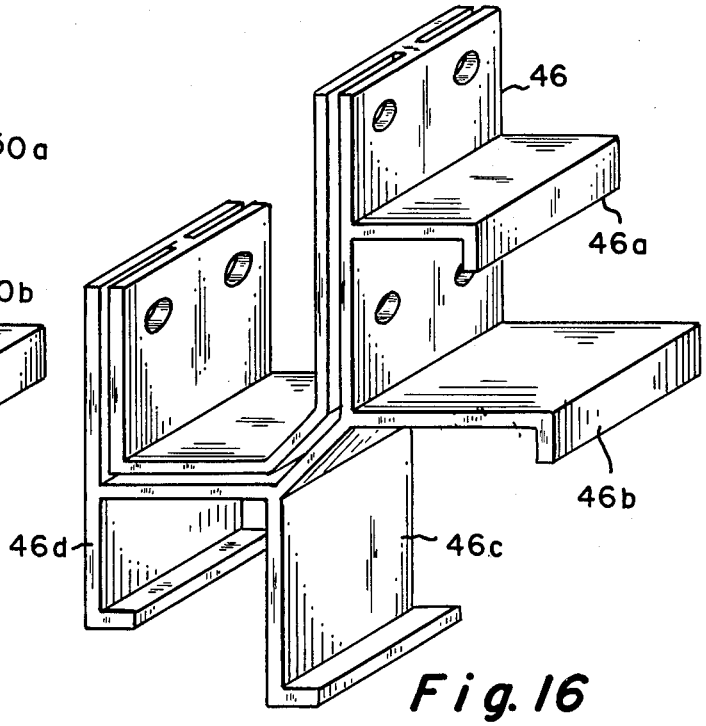

FIGS. 18, 23, 24 and 25 show refractory tile or brick member 45 of conventional construction having side latching slot portions to receive leg and foot portions of hanger castings 44, 44*a* that are suspended from short length, relatively lightweight mounting I-beams 41 (see also FIG. 13). The upper latching fingers of the castings 44 are adapted to be mounted to extend downwardly from side portions of the bottom flange of each beam 41 and to have their latching leg and feet portions fit within corresponding latching slots of the tile members 45. Angle-shaped clips 42 may, as shown in FIG. 18, be welded to the inner ring 16 and secured by bolts 43 to an adjacent secondary beam to tie the inner ring 15 to and mount it on adjacent secondary beams 16, 16' and 16''. The spacing between inner apron tiles 40' and outer main tile members 45, may, as indicated in FIG. 18, be filled-in with furnace cement 39.

Figure 23:
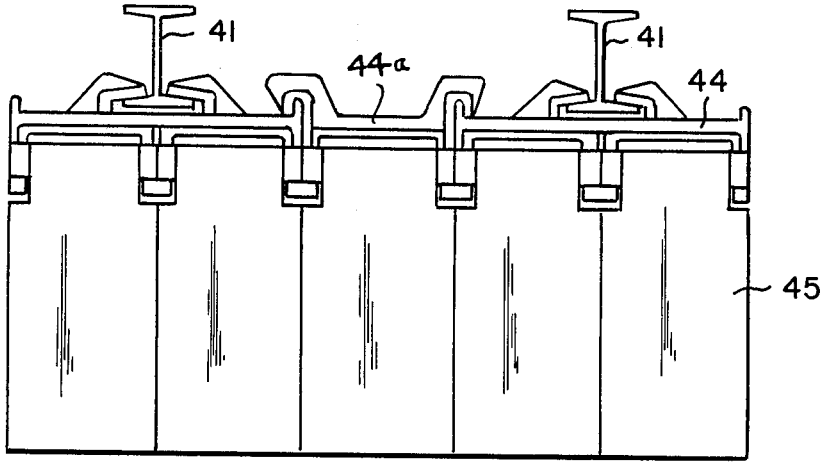
FIG. 23 is an end view in elevation and FIG. 24 is a side view in elevation showing details on the hanger casting suspension of central area enclosing tile members employed as illustrated in FIG. 18.
Figure 24:
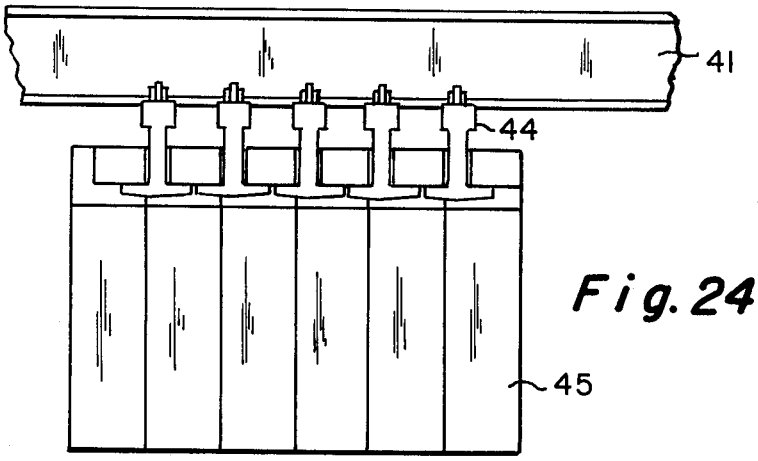
Figure 25:
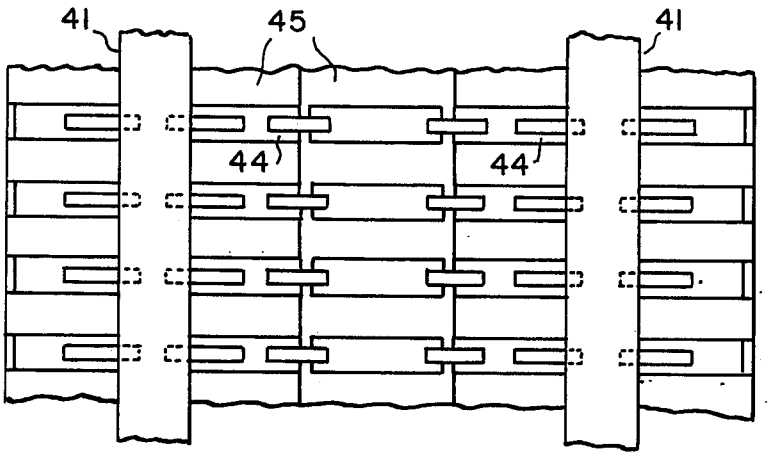
FIG. 25 is a fragmental plan view of the scale of and of the tile assembly of FIG. 23.

The main central portion of the roof B may utilize conventional hanger castings and tile members, as indicated in FIGS. 23 to 25 and as further illustrated in my U.S. Pat. No. 2,738,744 of Mar. 20, 1956, see for example, FIGS. 1 to 6, inclusive, thereof. To define and close-off the areas about the electrodes E, especially constructed hanger castings 46, 50 and 50' are provided, see FIGS. 15, 16, 17 and 18. The casting 46, as shown particularly in FIG. 18, may be suspended from and mounted on an adjacent portion of the ductwork, such as 20 by bolt and nut assemblies 43 to project downwardly therefrom. In FIG. 18, bolt and nut assemblies 43 are shown utilized for various mounting operations.

Innermost ends of tertiary beams 41 (see FIGS. 13 and 18) are shown mounted on beams, such as 17, 17', by the use of clips 38, and at their outermost ends are secured to the inner ring 15 and to the upper flanges of the beams 16, 16' and 16''. As shown in FIG. 13, where the hanger supporting and carrying beams need additional support adjacent one end thereof, then cross-extending tertiary beams 41 may be employed and serve as above-positioned suspending members for the hanger castings 44, 44*a* and refractory tiles 45. The tertiary support beams 41 are shown secured to extend along the same upper plane as the inner ring member 15. In this construction, metal work is minimized, is subjected to a maximized cooling action of cooling fluid, the weight of the roof B is minimized and enables the refractory tile or block members to be suspended both in central and apron areas thereof.

Again referring to FIGS. 17 and 18, the area about each electrode hole portion is defined by assemblies of tile members 47, 48, 49, 51 and 53. A first group of interfitting tile members 47, 48, 49 and 53 is carried in a suspended relation by four, offset, latching leg and foot portions 46*a*, 46*b*, 46*c* and 46*d* of a unitary hanger castng bracket 46 (see also FIG. 16). A second group of especially shaped interfitting tile members 49, 51 and 53 is carried by a pair of like, half hanger casting brackets 50 and 50' (see also FIG. 15) that are adapted to be mounted in a back to back relation with respect to each other. Each of the hangers 50, 50' has three offset latching leg and foot portions 50*a*, 50*b* and 50*c* to engage and suspend associated tile members 49, 51 and 53. The hangers 46 and 50 have upper, inwardly projecting leg and foot portions 46*a*, 50*a* which cooperate with each other to serve as peripheral shelf support flanges for a refractory annulus or closing-off ring 58 about each electrode hole. This construction enables a quick and simple replacement of the immediate hole defining and closing-off ring 58 that is provided for each electrode E.

With reference to FIGS. 26 to 28, inclusive, a typical furnace and roof mounting is illustrated in which the furnace A (such, for example, as produced by Swindell-Dressler) is shown as having a body carried on a base 57 that is provided with convexly rounded gear teeth segments 62. The teeth of the segments 62 cooperate with planar gear teeth segments 61 that are carried on stands 60. Tilting of the furnace A is accomplished by a fluid motor 63 that is mounted on the floor and has a piston rod 64 connected to the base 57 through a pivot 65. The roof B may be latched in a "down" positon by four heavy latching pins that fit within receiving sockets 9*a* carried by a metal shell (see FIG. 18), at for example, 90° spaced locations along the top rim portion 9 of the furnace. A quadrant group of gussets 12 having horizontally spaced-apart or bifurcated wing flanges project outwardly from the outer ring 10 and at their lower edges are adapted to rest on the lip portion 9. The metal housing of the furnace A has a group of four, equally spaced-apart latching sockets 9*a*, see FIG. 26, that are adapted to receive latching pins.

A conventional system for raising and lowering the furnace roof is illustrated and makes use of a rear end-positioned turret or elevating frame 59 that is motor driven to raise a ram ratchet and thus to raise and lower the roof B. A turn table C is shown for swinging the roof B from and towards the furnace A. The turn table C may carry a pair of overhead support arms 55 that are secured to the structural frame of the roof B by a group of spacer pins 56, see also FIGS. 26 and 27. The electrodes E may be swung by a conventional mechanism such as fluid motor-driven rack and gear assembly D.

As shown particularly in FIGS. 1 to 4, inclusive, the assembly of supporting members about the exhaust hole carry an upwardly and sidewise extending fume exhaust hood F. The hood F has an outer enclosing metal shell 67 and a cemented-in-place inner refractory lining 66. A plurality of spaced-apart, through-extending holes or openings are provided by short length pipes 68 that extent through the wall. The openings provide mixing and cooling air that assures a full combustion of gases leaving the furnace, and a cooling of them before they are taken-off to a usual dust recovery stack system.

Figure 2:
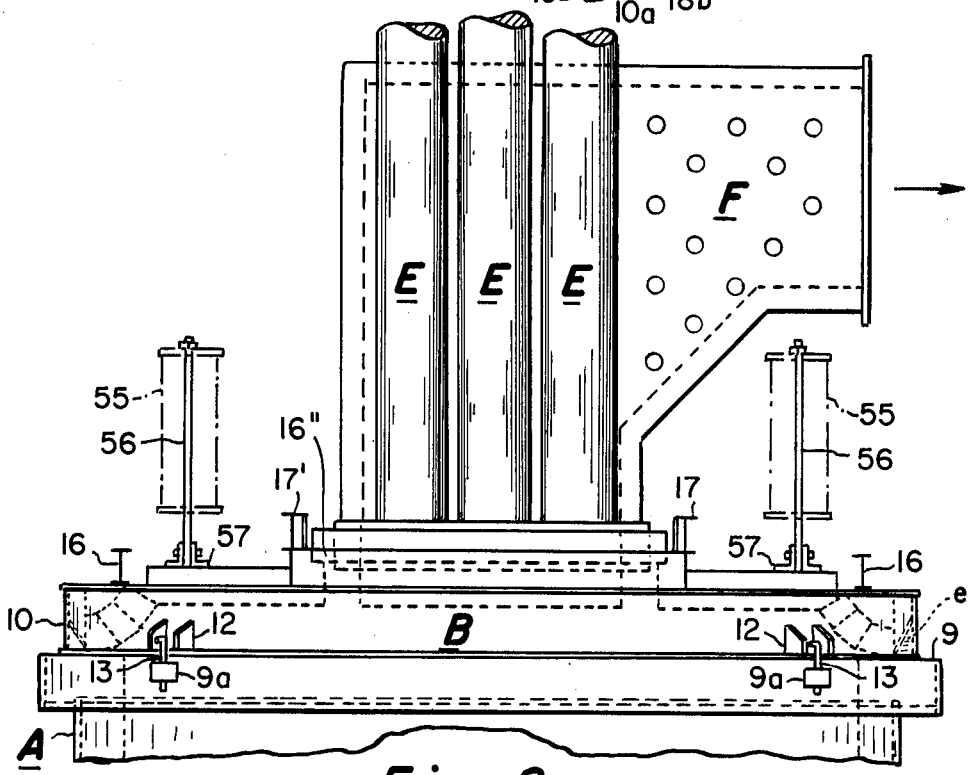
FIG. 2 is an elevation of the construction of and taken from the front end of FIG. 1.
Figure 3:
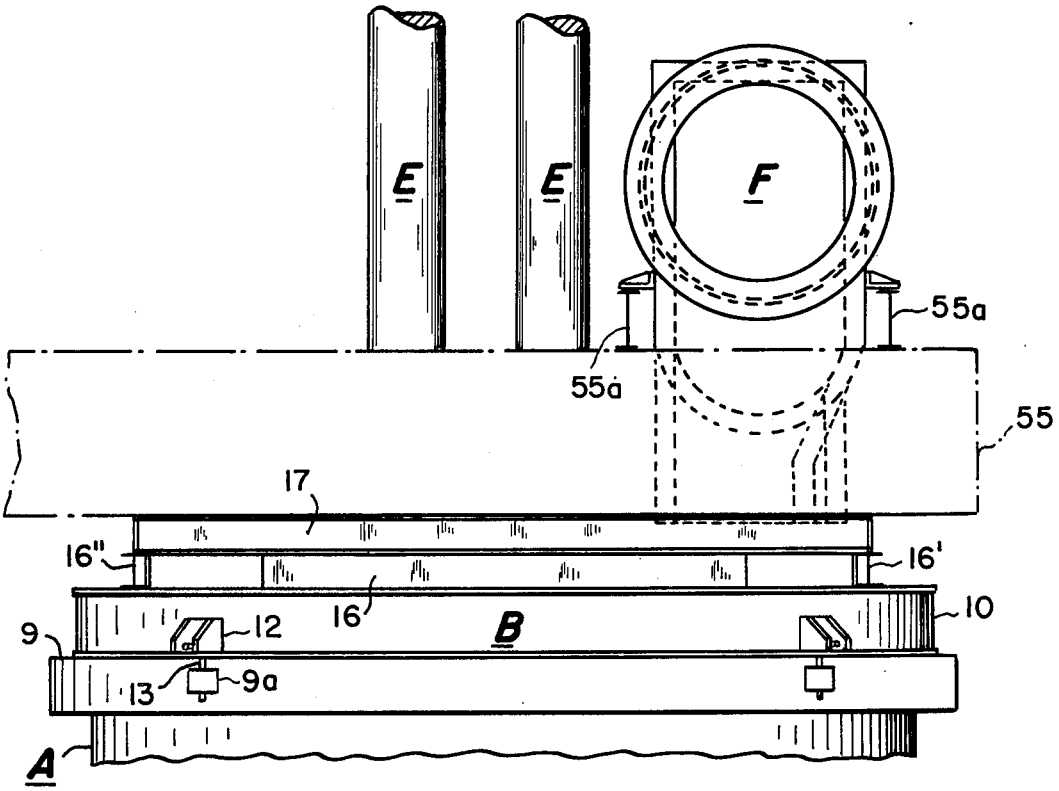
FIG. 3 is a fragmental side view in elevation on the scale of FIGS. 1 and 2 and of the construction shown in such figures.
Figure 4:
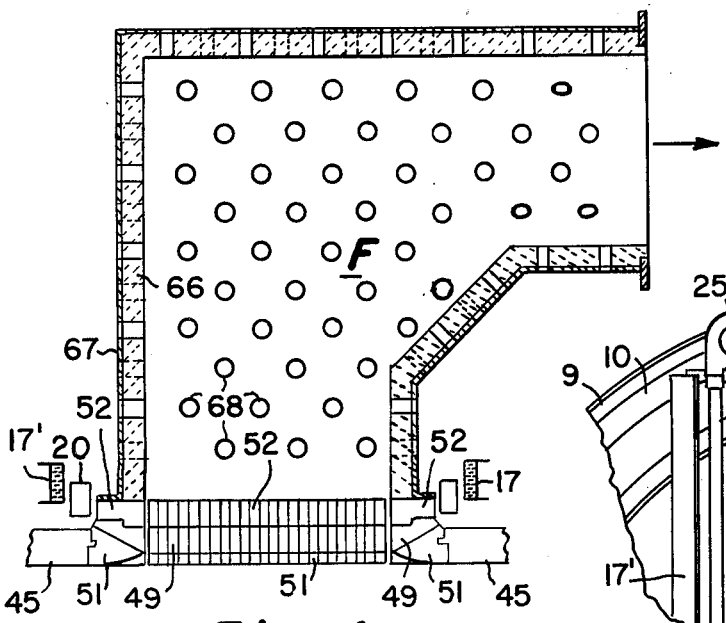
FIG. 4 is an end section in elevation taken along line IV—IV of FIG. 1 and particularly illustrating the construction of a fume exhaust hood.
Figure 5:
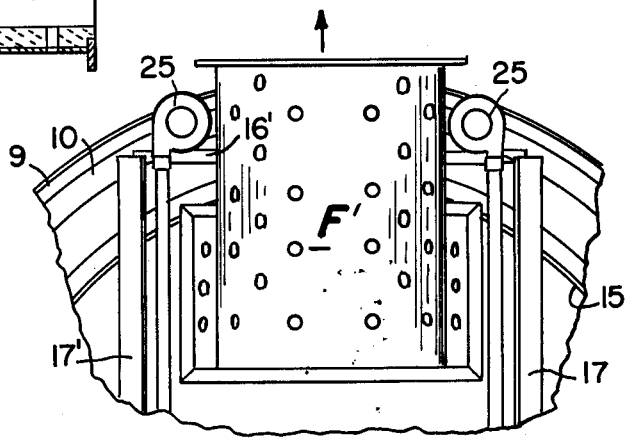
FIG. 5 is a fragmental top plan view of a modified roof construction in which the fume exhaust hood is positioned to extend endwise rather than sidewise of the roof.

FIGS. 1, 2 and 4 show a preferred, side-extending and delivering type of mounting of the fume exhaust hood F that may be carried, as shown in FIGS. 3 and 26, on a pair of cross-extending beam members 55*a*, slightly above the suspended roof B. The beam members 55*a* are adapted to extend across and rest on overhead support arm members 55 that, as previously indicated, may be secured to the structural frame of the roof by spacer pins 56 (see FIGS. 2, 26 and 27). An alternate type of hood F′ is shown in FIG. 5 which is shown adapted to extend towards and deliver its effluent to a front-positioned, fixed exhaust system, opposite to the turret end of the roof B. The weight of the hood F or F′ is thus carried directly by overhead beam members above the refractories and their immediate suspending frame member structure.

The ductwork 20, 23 constitutes a heat-resistant, supplemental or tertiary metal frame structure that is carried within the confines of and by the overhead frame structure represented by beam members 17, 16′, 17′ and 16″ of FIGS. 1 and 6; it has a basic important purpose in providing a supporting framework for the refractory tile members that are suspended about the fume and electrode hole portions of the central area of the suspended roof B. This supporting frame structure 20, 23 serves to carry in a suspended relation the tile members, such as those illustrated in FIGS. 13 and 18, that provide the immediate closing or surrounding members for the three electrode hole portions, as well as the fume exhaust hole portion. Due to the heat involved in such central areas of the furnace, it has been found advisable to use stainless steel for the supporting framework 20, 23. By providing such framework in the form of hollow ductwork, a further improvement in the life of the metal structure as well as of the tile members is enabled by employing such framework to apply cooling fluid such as air as down-flow curtains about the open portions or areas.

I claim:

1. An improved liftable roof for an electric furnace and the like that has a mouth ledge portion with respect to which the roof is to be lowered into a closing-off position and lifted into an open position which comprises, an outer fluid-cooled metal roof ring adapted to rest on the ledge portion, an inner metal roof ring in a radially-inwardly spaced relation with respect to said outer ring, a first group of refractory tile members defining a roof skirt positioned between and carried by said inner and outer rings, an overhead frame structure connecting said inner and outer rings in a secure relation with respect to each other, a substantially centrally disposed heat-resistant supplemental metal frame structure carried within the confines of and by said overhead frame structure, a second group of refractory tile members defining a central roof part within the confines of said inner ring and having a fume exhaust hole portion and spaced-apart electrode hole portions therein, and said supplemental metal frame structure carrying refractory tile members of said second group adjacent said fume exhaust and electrode hole portions.

2. An improved liftable roof as defined in claim 1 wherein hanger castings are carried by said overhead frame structure and said supplemental frame structure for carrying said second group of refractory tile members in a suspended relationship therefrom.

3. An improved liftable roof as defined in claim 1 wherein said overhead frame structure comprises, a substantially rectangular frame that connects said inner and outer rings, and frame members that extend across and are carried between said inner ring and said rectangular frame.

4. An improved liftable roof as defined in claim 1 wherein hanger castings are carried by said overhead frame and said supplemental frame structures to suspend said second group of refractory tile members in a substantially planar relationship from said roof skirt and along the central roof part.

5. An improved liftable roof as defined in claim 1 wherein said supplemental frame structure comprise members of ductwork construction having means for applying cooling fluid upon the central roof part between said hole portions thereof.

6. An improved liftable roof as defined in claim 1 wherein a refractory-lined air-vented hood is positioned above and connected to said fume exhaust hole portion and is carried by said overhead frame structure to extend towards an outer edge of the roof.

7. An improved liftable roof as defined in claim 1 wherein electrical insulating means is employed with said supplemental metal frame structure to isolate flow of electrical flux generated by operation of electrodes within the furnace.

8. An improved liftable roof as defined in claim 1 wherein, hanger castings extend radially inwardly and upwardly between and are carried by said outer and inner rings, and said first group of refractory tile members is suspended from said hanger castings.

9. An improved liftable roof as defined in claim 8 wherein, hanger castings are carried by said supplemental frame structure and said overhead frame structure within the confines of said inner roof ring, and said second group of tile members is suspended from said latter-mentioned hanger castings.

10. An overhead liftable roof as defined in claim 1 wherein, said overhead frame structure has a group of secondary beam members in a horizontally extending and spaced-apart relation and in a quadrant defining relation with respect to each other, and said secondary beam members connect said inner and outer ring members with respect to each other.

11. An improved liftable roof as defined in claim 10 wherein, said overhead frame structure also has a group of transversely spaced-apart primary beam members that are connected at their ends by a pair of said opposed secondary beam members in an assembly of substantially rectangular shape, and said pair of secondary beam members and said pair of primary beam members are fluid-jacketed and together define a continuous cooling fluid flow path therealong.

12. An improved liftable roof as defined in claim 1 wherein, an exhaust hood is mounted over said fume exhaust hole portion and is carried by said overhead frame structure of the roof, said exhaust hood has an outer metal shell and an inner refractory lining, and a plurality of spaced-apart air in-flow openings extend through said shell and lining.

13. An improved liftable roof for an electric furnace and the like that has a mouth ledge portion with respect to which the roof is to be lowered into a closing-off position and lifted into an open position which comprises, an outer fluid-cooled metal roof ring adapted to rest on the ledge portion, an inner metal roof ring in a radially-inwardly spaced relation with respect to said outer ring, a first group of refractory tile members defining a roof skirt positioned between and carried by said inner and outer rings, a second group of refractory tile members defining a central roof part within the confines of said inner ring and having a fume exhaust hole portion and spaced-apart electrode hole portions therein, an overhead metal frame structure connecting said inner and outer rings in a secure relation with respect to each other, a centrally disposed cooling fluid dispersing ductwork carried by said overhead frame structure, said ductwork being positioned to extend about said fume exhaust hole and said electrode hole portions, and said ductwork having means for applying cooling fluid curtains to the central roof part between said hole portions.

14. An improved liftable roof as defined in claim 13 wherein means cooperates with said ductwork for suspending members of said second group of tile members of said central roof part.

15. An improved liftable roof as defined in claim 13 wherein, cooling fluid supply means is connected to said ductwork, and said ductwork has downwardly projecting cooling fluid-dispensing orifices therealong.

16. An improved liftable roof as defined in claim 15 wherein said cooling fluid supply means comprises motor-driven air blowers that are mounted on said overhead frame structure of the roof.

17. An improved liftable roof as defined in claim 13 wherein, said overhead frame structure has a pair of horizontally extending and transversely spaced-apart primary beam members which carry said ductwork and said ductwork is positioned within the confines of the spacing between said pair of primary beam members.

18. An improved liftable roof as defined in claim 17 wherein said pair of primary beam members are provided with means for fluid cooling them along their lengths.

19. An improved liftable roof as defined in claim 17 wherein, each member of said pair of primary beam members has fluid-jacketing therealong, a pair of secondary beam members are positioned in an opposed spaced-apart relation with respect to each other at opposite ends of said pair of primary beam members, each member of said pair of secondary beam members has fluid-jacketing therealong, and means connects the fluid jacketing of said primary and secondary pairs of beam members to provide a continuous cooling fluid flow path therealong.

20. An improved liftable roof for an electric furnace and the like having a mouth ledge portion with respect to which the roof is to be lowered into a closing-off position for furnace operation and to be lifted into an open furnace-charging position which comprises, an outer fluid-cooled metal roof ring member adapted to rest on the ledge portion, an inner metal roof ring member in a radially inwardly and upwardly spaced relation with respect to said outer ring member, a first group of refractory tile members defining a roof skirt and positioned between said inner and outer ring members, a second group of refractory tile members defining a central roof part within the confines of said inner ring member, a fluid-cooled and dispersing ductwork positioned along said central roof part and, with said inner ring member, suspending said second group of refractory tile members in a mounted relation therebetween, and said second group of refractory tile members defining a fume exhaust hole portion and electrode hole portions in said central roof part.

21. An improved liftable roof as defined in claim 20 wherein a ceramic ring is carried by said ductwork in a closely encircling relation about each of said electrode hole portions to by-pass an electrode therethrough for projection into the furnace.

22. An improved liftable roof for an electric furnace as defined in claim 20 wherein, said ductwork extends about said fume exhaust and electrode hole portions in a spaced relation with respect thereto, hanger castings are carried by said ductwork to suspended tile members of said central roof part about said open portions, and means is carried by the roof for supplying cooling fluid to said ductwork and through said ductwork upon said hanger castings and adjacent refractory tile members.

23. An improved liftable roof as defined in claim 20 wherein, a pair of fluid-cooled transversely spaced-apart side-positioned primary beam members extending longitudinally across between opposite portions of said ring members, a pair of secondary and end-positioned beam members extend in a connecting cross-extending relation between opposite ends of said pair of primary beam members; a pair of secondary side beam members extend along opposite sides of the roof substantially parallel to and in an outwardly spaced relation with respect to said pair of primary side beam members to, with said secondary end-positioned beam members, secure said inner and outer ring members in a connected relation with respect to each other; and said inner ring member is positioned in an upwardly offset and connected relation with respect to said outer ring member by said secondary beam members.

24. An improved liftable roof as defined in claim 23 wherein, said pair of primary beam members and said secondary end-positioned beam members define a continuous cooling fluid flow chamber therealong, a cooling fluid inlet and outlet are connected to said flow chamber, a hood having a refractory-lined wall extends upwardly from said fume exhaust hole portion and towards said outer ring member, and a plurality of open-end pipe members extend through said wall to supply air to the interior of said hood.

25. An improved liftable roof for an electric furnace and the like that has a mouth ledge portion with respect to which the roof is to be lowered into a closing-off position and lifted into an open position which comprises, an outer fluid-cooled metal roof ring adapted to rest on the ledge, an inner metal roof ring in a radially inwardly spaced relation with respect to said outer ring, an overhead frame structure connecting said inner and outer rings in a secure relation with respect to each other, said frame structure having a pair of horizontally spaced-apart and extending fluid-cooled primary side beam members and a pair of spaced-apart and horizontally extending fluid-cooled end beam members secured in an end-to-end relation with said primary beam members and defining a fluid-cooled substantially rectangular frame therewith, a first group of refractory tile members defining a roof skirt and positioned between and carried by said inner and outer roof rings, a second group of refractory tile members defining a central part of the roof within the confines of said inner ring and having a fume exhaust hole portion and spaced-apart electrode hole portions therein, and said secondary group of tile members being suspended by said overhead frame structure.

26. An improved liftable roof as defined in claim 25 wherein, hanger castings are suspended between said inner and outer roof rings and in turn suspend said first group of refractory tile members, and hanger castings are carried by said overhead frame structure and suspend said second group of tile members within the central part of the roof.

27. An improved liftable roof as defined in claim 25 wherein, a pair of secondary side beam members extend in a substantially longitudinally parallel and transversely outwardly spaced relation with respect to said pair of primary beam members, and said secondary side beam members and said end beam members extend across and between and secure said inner and outer ring members with respect to each other along opposite portions of the roof.

28. An improved liftable roof as defined in claim 27 wherein, a centrally disposed cooling fluid carrying and dispensing ductwork is carried by said rectangular frame structure within the confines thereof and said ductwork is electrically insulated with respect to said rectangular frame and positioned to extend about the fume exhaust and electrode hole portions within the central part of the roof.

* * * * *